US010924848B2

(12) United States Patent
Cox

(10) Patent No.: US 10,924,848 B2
(45) **Date of Patent: *Feb. 16, 2021**

(54) THROWABLE MICROPHONE LIGHTING WITH LIGHT INDICATION

(71) Applicant: PeeQ Technologies, LLC, St. George, UT (US)

(72) Inventor: Shane Cox, Cary, NC (US)

(73) Assignee: PeeQ Technologies, LLC, St. George, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/517,918

(22) Filed: Jul. 22, 2019

(65) Prior Publication Data

US 2020/0029143 A1 Jan. 23, 2020

Related U.S. Application Data

(60) Provisional application No. 62/702,236, filed on Jul. 23, 2018.

(51) Int. Cl.

| | |
|---|---|
| ***H04R 3/00*** | (2006.01) |
| ***F21V 33/00*** | (2006.01) |
| ***G08B 5/36*** | (2006.01) |
| ***H04R 1/08*** | (2006.01) |
| ***H04R 1/04*** | (2006.01) |

(52) U.S. Cl.

CPC ..... *H04R 3/00* (2013.01); *F21V 33/0056* (2013.01); *G08B 5/36* (2013.01); *H04R 1/04* (2013.01); *H04R 1/08* (2013.01); *H04R 2420/07* (2013.01)

(58) Field of Classification Search

None

See application file for complete search history.

(56) References Cited

U.S. PATENT DOCUMENTS

| | | | |
|---|---|---|---|
| 8,989,420 | B1 | 3/2015 | Hamer et al. |
| 2015/0289074 | A1 | 10/2015 | Kauppila et al. |
| 2016/0345087 | A1 | 11/2016 | Cox |
| 2018/0206035 | A1 | 7/2018 | Cox |

OTHER PUBLICATIONS

Cross. "Catchbox: The Throwable Microphone [Review]." In: Skift Inc. Mar. 23, 2016 (Mar. 23, 2016) Retrieved on Oct. 29, 2019 (Oct. 29, 2019) from <https://www.eventmanagerblog.com/catchbox-review> entire document.

International Search Report and Written Opinion as issued in connection with International Patent Application No. PCT/US2019/043118, dated Nov. 20, 2019, 10 pages.

*Primary Examiner* — Qin Zhu

(57) ABSTRACT

Some embodiments include a throwable microphone system. A throwable microphone system may include: a throwable microphone body; a throwable microphone disposed within the throwable microphone body; a throwable wireless transceiver that receives audio signals from the throwable microphone and wirelessly communicates the audio signals to a remote transceiver and receives a light configuration signal from the remote transceiver; a controller in electrical communication with the throwable microphone and the throwable wireless transceiver that establishes a light configuration state based at least in part on the light configuration signal; and a plurality of lights in electrical communication with the controller, the plurality of lights illuminate based on the light configuration state.

18 Claims, 9 Drawing Sheets

THROWABLE MICROPHONE LIGHTING WITH LIGHT INDICATION

BACKGROUND

Classrooms and large conference rooms often require the participation of a number of people in the ongoing presentation or activity. Using microphones and speakers makes it easier for people sitting throughout the room, to be able to clearly present their points and/or speech, while making it easier for the rest to hear.

SUMMARY

A smart microphone system is disclosed. In some embodiments, a smart microphone system may include a control microphone subsystem, a throwable microphone subsystem, and a smart microphone receiver. In some embodiments, the control microphone subsystem may include: a control microphone; a control wireless transmitter that receives control audio signals from the control microphone and configured to wirelessly communicates the control audio signals; and a button that switches between a control microphone state and a throwable microphone state;

In some embodiments the throwable microphone subsystem may include a throwable microphone body; a throwable microphone disposed within the throwable microphone body; and a throwable wireless transmitter that receives throwable audio signals from the throwable microphone and is configured to wirelessly communicates the throwable audio signals; and In some embodiments, the smart microphone receiver may include: a wireless receiver that receives the control audio signals from the control wireless transmitter and the throwable audio signals from the throwable transmitter; and an output that outputs the throwable audio signals when the button is in the throwable microphone state and outputs the control audio signals when the button is in the control microphone state.

In some embodiments, the control microphone subsystem comprises one or more lights that indicate whether the button is in the control microphone state or the throwable microphone state.

In some embodiments, the one or more lights are arranged in a ring around the control microphone body.

In some embodiments, wherein the throwable microphone body comprises a spherical shape; and wherein the one or more lights comprise a plurality of lights arranged in a ring around the spherical body.

In some embodiments, the control microphone subsystem comprises a red light that is illuminated when the button is in the control microphone state.

In some embodiments, the control microphone subsystem comprises a green light that is illuminated when the button is in the throwable microphone state.

In some embodiments, wherein the control wireless transmitter communicates a button state signal indicating whether the button is in the throwable microphone state or the control microphone state.

In some embodiments, the control wireless transmitter communicates a button state signal when the button is switched between the throwable microphone state and the control microphone state.

Some embodiments include a throwable microphone system. A throwable microphone system may include: a throwable microphone body; a throwable microphone disposed within the throwable microphone body; a throwable wireless transceiver that receives audio signals from the throwable microphone and wirelessly communicates the audio signals to a remote transceiver and receives a light configuration signal from the remote transceiver; a controller in electrical communication with the throwable microphone and the throwable wireless transceiver that establishes a light configuration state based at least in part on the light configuration signal; and a plurality of lights in electrical communication with the controller, the plurality of lights illuminate based on the light configuration state.

In some embodiments, the remote transceiver comprises a wireless transceiver that receives audio signals from the throwable wireless transceiver and communicates the light configuration signal; and an output that outputs the audio signals.

In some embodiments, the throwable microphone body comprises a spherical shape with a flat portion.

In some embodiments, the plurality of lights are arranged in a ring around an arc of the spherical shape.

In some embodiments, the plurality of lights are arranged in a ring around a circumference of the spherical shape.

In some embodiments, the throwable microphone system may also include an orientation sensor in electrical communication with the controller, the orientation sensor produces an orientation signal, and the controller establishes the light configuration state based at least in part on the orientation signal.

In some embodiments, the throwable microphone body comprises a spherical shape with a flat portion, the plurality of lights are illuminated with a first color when an orientation sensor disposed within the throwable microphone body indicates that the flat portion is facing upward, and the plurality of lights are illuminated with a second color when the orientation sensor indicates that the flat portion is facing downward.

In some embodiments, the throwable microphone is muted when the orientation sensor indicates that the flat portion is facing downward.

In some embodiments, the light configuration state comprises a lighting sequence where at least a subset of the plurality of lights flash on and off for a period of time and at a frequency according to the light configuration state.

A method is also disclosed that includes illuminating a plurality of lights coupled with a throwable microphone with a first color; receiving audio signals from a microphone disposed within the throwable microphone; transmitting the audio signals to a wireless receiver;

receiving a microphone mute signal from a controllable microphone; receiving an orientation signal from an orientation sensor disposed within the throwable microphone; setting the microphone state to mute when the orientation signal indicates the throwable microphone is facing downward; setting the microphone state to mute when the microphone mute signal indicates that the throwable microphone should be muted; and illuminating the plurality of lights coupled with a throwable microphone with a second color when the microphone state is set to mute.

In some embodiments, the microphone mute signal is received from the controllable microphone through the wireless receiver.

In some embodiments, the method may also include muting the microphone when the microphone state is set to mute.

These illustrative embodiments are mentioned not to limit or define the disclosure, but to provide examples to aid understanding thereof. Additional embodiments are discussed in the Detailed Description, and further description is provided there. Advantages offered by one or more of the various embodiments may be further understood by examining this specification or by practicing one or more embodiments presented.

BRIEF DESCRIPTION OF THE FIGURES

These and other features, aspects, and advantages of the present disclosure are better understood when the following Disclosure is read with reference to the accompanying drawings.

DISCLOSURE

Systems and methods are disclosed for using a smart microphone system that includes a throwable microphone, a virtual assistant, and/or a control microphone. In some embodiments, the control microphone can be used to mute or unmute the throwable microphone. In some embodiments, the control microphone can be used to send voice commands to the virtual assistant.

Figure 1:
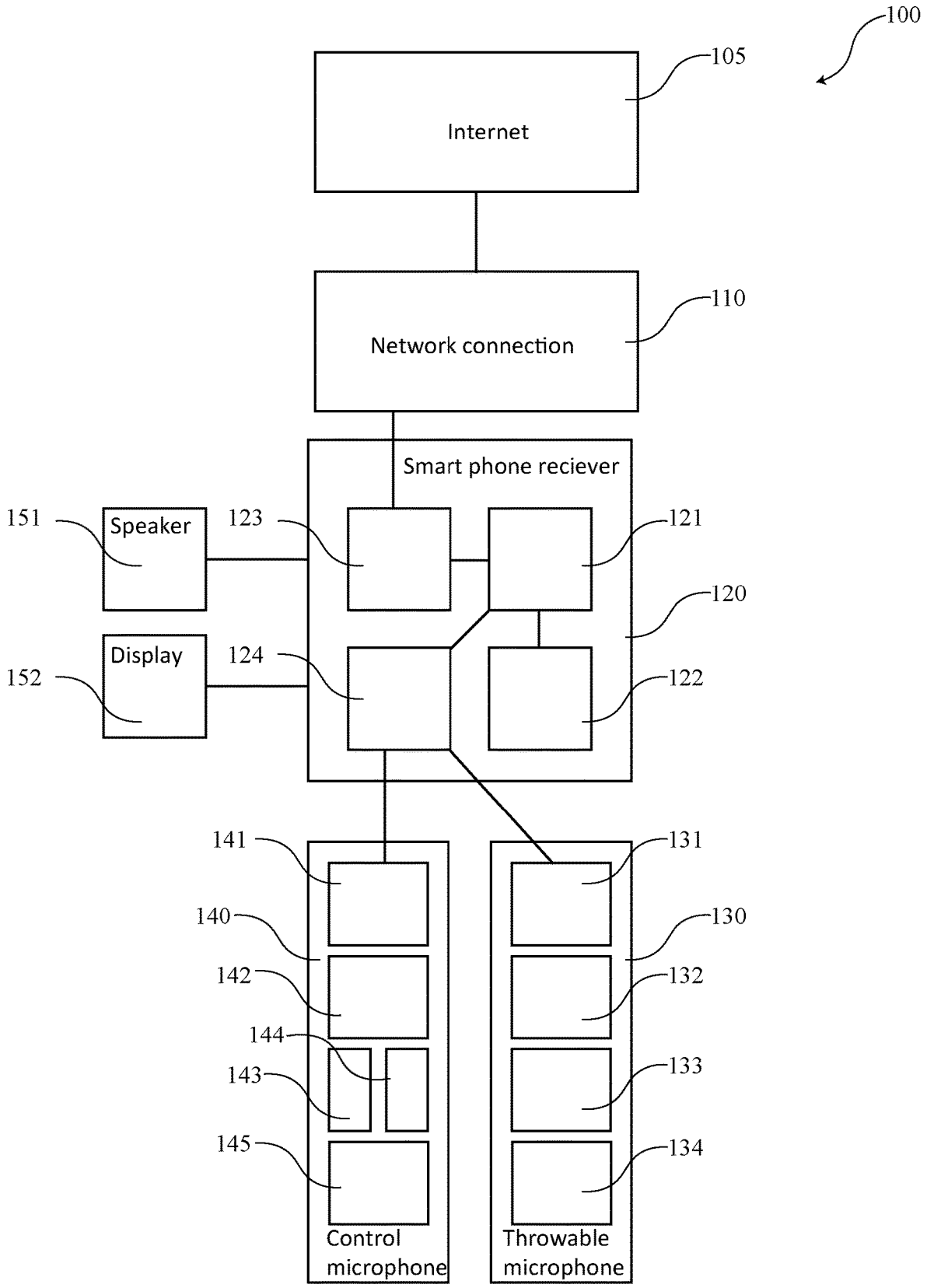
FIG. 1 is a block diagram of a smart microphone system according to some embodiments.

FIG. 1 is a block diagram of a smart microphone system 100 according to some embodiments. The smart microphone system 100 includes a smart microphone receiver 120. The smart microphone receiver 120 may include a processor 121, a virtual assistant processor 122, a network interface 123, a wireless microphone interface 124, etc.

In some embodiments, the smart microphone receiver 120 may include the receiver described in U.S. patent application Ser. No. 15/158,446, which is incorporated herein in its entirety for all purposes.

Figure 7:
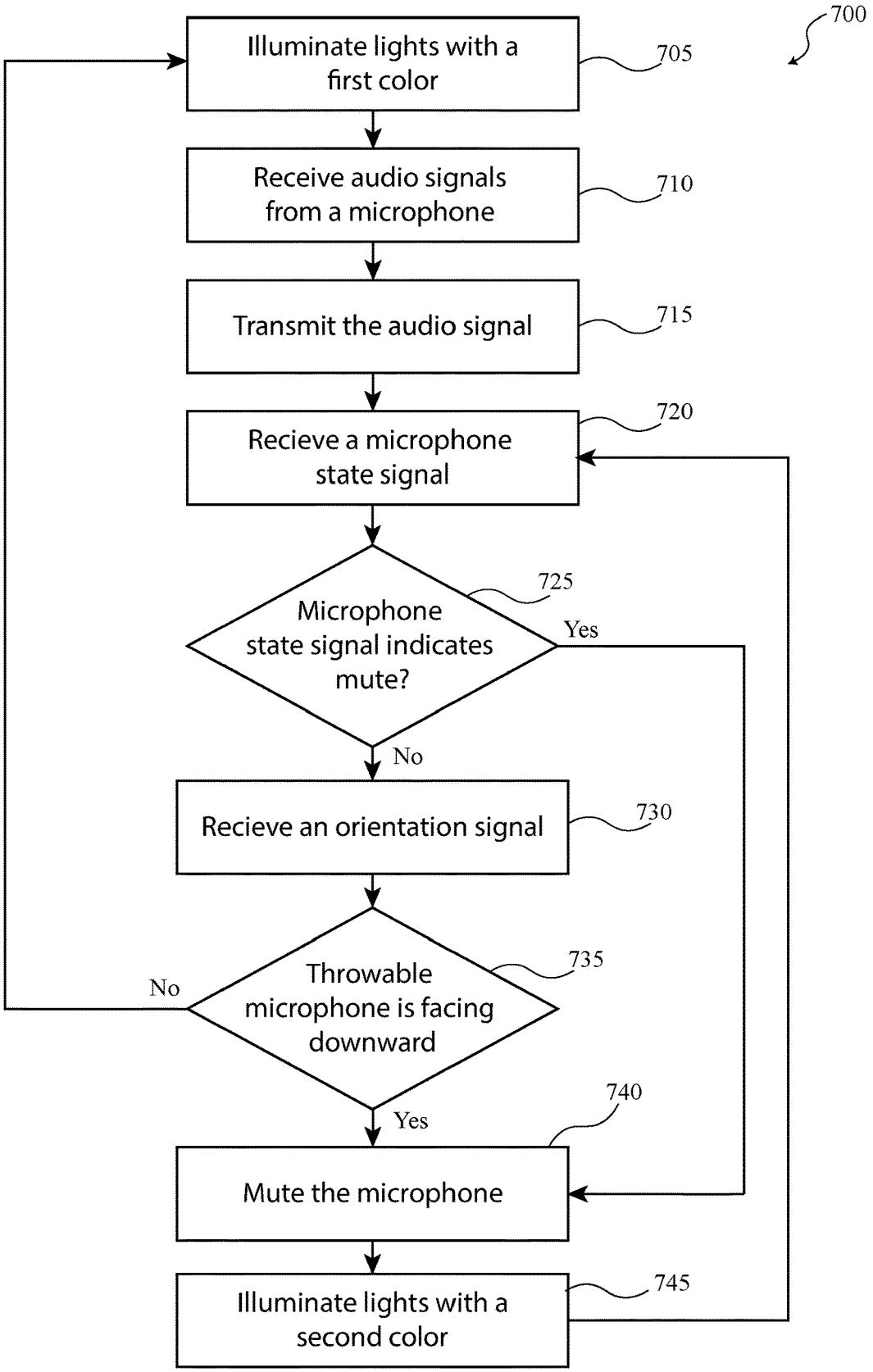
FIG. 7 is a flowchart of a process at a throwable microphone system according to some embodiments.

The processor 121 may include one or more components of the computational system 700 shown in FIG. 7. The processor 121 may control the operation of the various components of the smart microphone receiver 120.

The virtual assistant processor 122 may include one or more components of the computational system 700 shown in in FIG. 7. In some embodiments, the virtual assistant processor 122 may be a separate processor from processor 121 or it may be part of processor 121. The virtual assistant processor 122, for example, may be capable of voice interaction from voice commands received from either the control microphone subsystem 140 and/or the throwable microphone subsystem 130; music playback; video playback; internet searches; information retrieval; making to-do lists; setting alarms; streaming podcasts; playing audiobooks; providing weather, traffic, sports, news, and other real-time information; etc., etc. To provide these services, for example, the virtual assistant processor 122, may access the Internet 105 via the network interface 123.

In some embodiments, the virtual assistant processor 122 may send audio to a virtual assistant server (e.g., Amazon Voice Service, Siri Service, Google Assistant Service, etc.) on the Internet 105 (e.g., in the cloud). In response, the virtual assistant server may respond with information, questions, data, streaming of data, music, videos, images, etc. In some embodiments, the virtual assistant processor 122 may be an Alexa-enabled device, a Siri-enable device, a Google Assistant enabled device, etc.

In some embodiments, the virtual assistant processor 122 may include interfaces, processes, and/or protocols that correspond to client-functionality, like speech recognition, audio playback, and volume control. Each interface may, for example, include logically grouped messages such as, for example, directives and/or events. For example, directives are messages sent from the virtual assistant server instructing the virtual assistant processor 122 to perform a function. Events are messages sent from the virtual assistant processor 122 to the virtual assistant server notifying it that something has occurred.

In some embodiments, the virtual assistant processor 122 may include voice recognition software, speech synthesizer software, etc. In some embodiments, the virtual assistant processor 122 may send security data, encryption keys, validation data, identification data, etc. to the virtual assistant server.

In some embodiments, wireless microphone interface 124 may wirelessly communicate with either or both the control microphone subsystem 140 and/or the throwable microphone subsystem 130. In some embodiments, the wireless microphone interface 124 may include a transmitter, a receiver, and/or a transceiver. In some embodiments, the wireless microphone interface 124 may include an antenna. In some embodiments, the wireless microphone interface 124 may include an analog radio transmitter. In some embodiments, the wireless microphone interface 124 may communicate digital or analog audio signals over the analog radio. In some embodiments, the wireless microphone interface 124 may wirelessly transmit radio signals to the receiver device. In some embodiments, the wireless microphone interface 124 may include a Bluetooth®, WLAN, Wi-Fi, WiMAX, Zigbee, or other wireless device to send radio signals to the receiver device. In some embodiments, the wireless microphone interface 124 may include one or more speakers or may be coupled with one or more speakers.

In some embodiments, the network connection 110 may include any type of interface that can connect a computer to the Internet 105. In some embodiments, the network connection 110 may include a wired or wireless router, one or more servers, and/or one or more gateways. In some embodiments, the network interface 123 may connect the smart microphone receiver 120 to the Internet 105 via the network connection 110 (e.g., via Wi-Fi or an ethernet connection).

In some embodiments, the smart microphone receiver 120 may be communicatively coupled with the speaker 151 and/or the display 152. The display, for example, may include any device that can display images such as a screen, projector, tablet, television, display, etc. In some embodiments, the smart microphone receiver 120 may play audio through the speaker 151 from the throwable microphone subsystem 130 and/or the control microphone subsystem 140. In some embodiments, the smart microphone receiver 120 may play audio through the speaker 151 streamed from the Internet 105. In some embodiments, the smart microphone receiver 120 may play video through display 152 streamed from the Internet 105 or stored at the smart microphone receiver 120. In some embodiments, the speaker 151 and/or the display 152 may or may not be integrated with the smart microphone receiver 120. In some embodiments, the speaker 151 may be internal speakers or external speakers.

In some embodiments, the throwable microphone subsystem 130 may include a wireless communication interface 131, processor 132, sensors 133, and/or a microphone 134.

In some embodiments, the throwable microphone subsystem 130 may include one or more or all of the components and/or include the functionality of the throwable microphone described in U.S. patent application Ser. No. 15/158,446, which is incorporated herein in its entirety for all purposes.

In some embodiments, the wireless communication interface 131 may communicate with the smart microphone receiver 120 via the wireless microphone interface 124. In some embodiments, the wireless communication interface 131 may include a transmitter, a receiver, and/or a transceiver. In some embodiments, the wireless communication interface 131 may include an antenna. In some embodiments, the wireless communication interface 131 may include an analog radio transmitter. In some embodiments, the wireless communication interface 131 may communicate digital or analog audio signals over the analog radio. In some embodiments, the wireless communication interface 131 may wirelessly transmit radio signals to the receiver device. In some embodiments, the wireless communication interface 131 may include a Bluetooth®, WLAN, Wi-Fi, WiMAX, Zigbee, or other wireless device to send radio signals to the receiver device. In some embodiments, the wireless communication interface 131 may include one or more speakers or may be coupled with one or more speakers.

In some embodiments, the processor 132 may include one or more components of the computational system 700 shown in in FIG. 7. In some embodiments, the processor 132 may control the operation of the wireless communication interface 131, sensors 133, and/or a microphone 134.

In some embodiments, the sensor 133 may include a motion sensor and/or an orientation sensor. In some embodiments, the sensor may include any sensor capable of determining position or orientation, such as, for example, a gyroscope. In some embodiments, the sensor 133 may measure the orientation along any number of axes, such as, for example, three (3) axes. In some embodiments, a motion sensor and an orientation sensor may be combined in a single unit or may be disposed on the same silicon die. In some embodiments, the motion sensor and the orientation sensor may be combined a single sensor device.

In some embodiments, a motion sensor may be configured to detect a position or velocity of the throwable microphone subsystem 130 and/or provide a motion sensor signal responsive to the position. For example, in response to the throwable microphone subsystem 130 facing upward, the sensor 133 may provide a sensor signal to the processor 132. The processor 132 may determine that the throwable microphone subsystem 130 is facing upward based on the sensor signal. As another example, in response to the throwable microphone subsystem 130 facing downward, the sensor 133 may provide a different sensor signal to the processor 132. The processor 132 may determine that the throwable microphone subsystem 130 is facing downward based on the sensor signal.

In some embodiments, signals from the sensor 133 may be used by the processor 132 and/or the processor 132 to mute and/or unmute the microphone.

In some embodiments, the microphone 134 may be configured to receive sound waves and produce corresponding electrical audio signals. The electrical audio signals may be sent to either or both the processor 132 and/or the wireless communication interface 131.

In some embodiments, a control microphone subsystem 140 may include a wireless communication interface 141, processor 142, throwable microphone mute button 143, a virtual assistant enable button 144, and/or a control microphone 145. In some embodiments, the control microphone subsystem 140 may include one or more lights (or LEDs) that may be used to indicate when either or both the smart microphone system 100 is in the mute (or unmute) state or is in the virtual assistant enable state.

In some embodiments, the wireless communication interface 141 may communicate with the smart microphone receiver 120 via the wireless microphone interface 124. In some embodiments, the wireless communication interface 141 may include a transmitter, a receiver, and/or a transceiver. In some embodiments, the wireless communication interface 141 may include an antenna. In some embodiments, the wireless communication interface 141 may include an analog radio transmitter. In some embodiments, the wireless communication interface 141 may communicate digital or analog audio signals over the analog radio. In some embodiments, the wireless communication interface 141 may wirelessly transmit radio signals to the receiver device. In some embodiments, the wireless communication interface 141 may include a Bluetooth®, WLAN, Wi-Fi, WiMAX, Zigbee, or other wireless device to send radio signals to the receiver device. In some embodiments, the wireless communication interface 141 may include one or more speakers or may be coupled with one or more speakers.

In some embodiments, the processor 142 may include one or more components of the computational system 700 shown in in FIG. 7. In some embodiments, the processor 142 may control the operation of the wireless communication interface 141, the throwable microphone mute button 143, the virtual assistant enable button 144, and/or the control microphone 145.

In some embodiments, the throwable microphone mute button 143 may include a button disposed on the body of the control microphone subsystem 140. The button may be electrically coupled with the processor 142 such that a signal is sent to the processor 142 when the throwable microphone mute button 143 is pressed or engaged. In response, the processor 142 may send a signal to the smart microphone receiver 120 indicating that the throwable microphone mute button 143 has been pressed or engaged. In response, the smart microphone receiver 120 may mute or unmute any sound received from the throwable microphone subsystem 130.

In some embodiments, the virtual assistant enable button 144 may include a button disposed on the body of the control microphone subsystem 140. The button may be electrically coupled with the processor 142 such that a signal is sent to the processor 142 when the virtual assistant enable button 144 is pressed or engaged. In response, the processor 142 may send a signal to the smart microphone receiver 120 indicating that the virtual assistant enable button 144 has been pressed or engaged. In response, the smart microphone receiver 120 may direct audio from either the control microphone subsystem 140 and/or the throwable microphone subsystem 130 to the virtual assistant processor 122.

In some embodiments, the control microphone 145 may be configured to receive sound waves and produce corresponding electrical audio signals. The electrical audio signals may be sent to either or both the processor 142 and/or the wireless communication interface 141.

In some embodiments, the smart microphone system 100 may incorporate any component, feature, characteristic, system, subsystem, etc. described in U.S. patent application Ser. No. 15/158,446, which is incorporated herein in its entirety for all purposes. In addition, the smart microphone system 100 may perform any function, process, method, algorithm, etc., described in U.S. patent application Ser. No. 15/158,446, which is incorporated herein in its entirety for all purposes.

Figure 2:
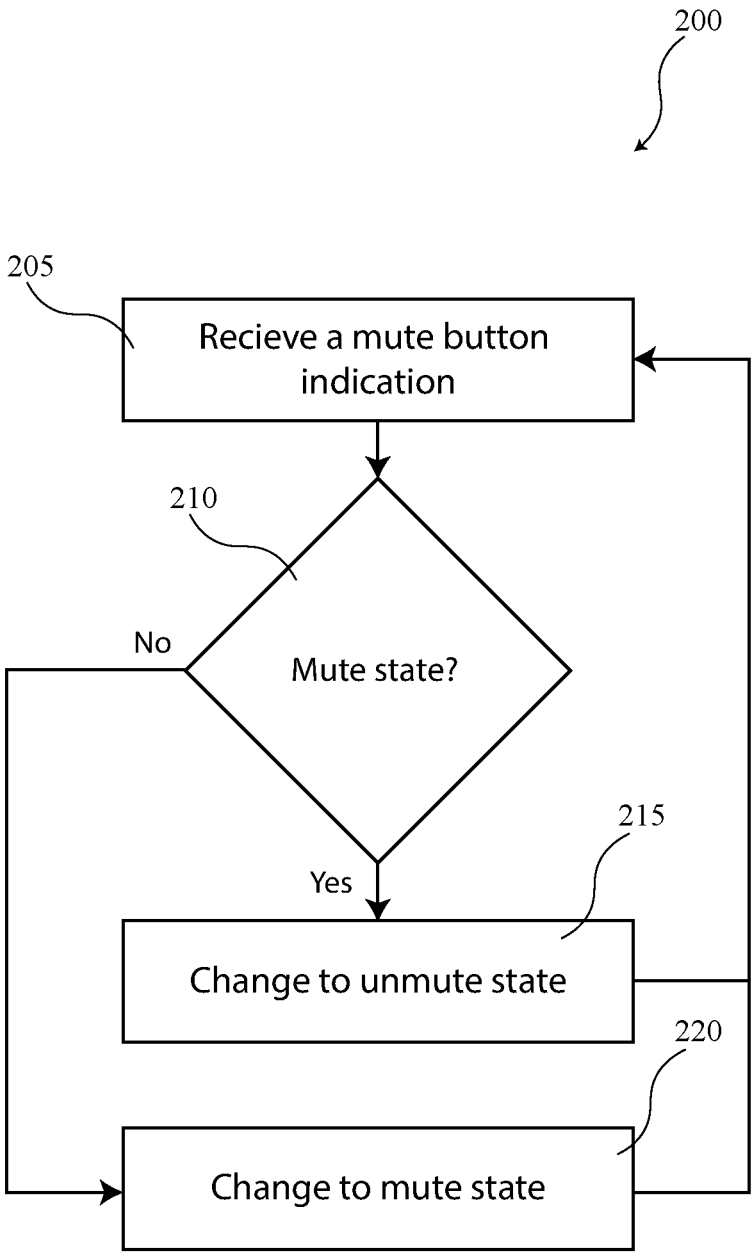
FIG. 2 is a flowchart of a process for muting a throwable microphone according to some embodiments.

FIG. 2 is a flowchart of a process 200 for muting a throwable microphone according to some embodiments. In some embodiments, the control microphone subsystem 140 may include a throwable microphone mute button 143. The throwable microphone mute button 143, for example, may be engaged to mute or unmute the microphone on the throwable microphone subsystem 130. Thus, a button on one microphone device (e.g., the control microphone subsystem 140) can be used to mute and unmute another microphone device (e.g., throwable microphone subsystem 130).

At block 205 a mute button indication can be received. For example, the processor 142 of the control microphone subsystem 140 can receive an electrical indication from the throwable microphone mute button 143 indicating that the throwable microphone mute button 143 has been pressed. Alternatively or additionally, if the throwable microphone mute button 143 is a switch, the processor 142 can receive an electrical indication that a switch has been moved from a first state to a second state. In some embodiments, the control microphone subsystem 140 can send a signal to the smart microphone receiver 120 indicating that the mute state has been changed.

At block 210, if the smart microphone system 100 is in the mute state, then process 200 proceeds to block 215. If the smart microphone system 100 is in the unmute state, then process 200 proceeds to block 220.

At block 215, the smart microphone system 100 is changed to the mute state. In some embodiments, the change to the mute state may be a change made within a memory location at the smart microphone system 100. In some embodiments, the change to the mute state may be a change made in a software algorithm or program. In some embodiments, a light (e.g., and LED) on the control microphone subsystem 140, the throwable microphone subsystem 130, and/or the smart microphone receiver 120 may be illuminated or unilluminated to indicate that the smart microphone system 100 is in the mute state.

At block 220, the smart microphone system 100 is changed to the unmute state. In some embodiments, the change to the unmute state may be a change made within a memory location at the smart microphone system 100. In some embodiments, the change to the unmute state may be a change made in a software algorithm or program. In some embodiments, a light (e.g., and LED) on the control microphone subsystem 140, the throwable microphone subsystem 130, and/or the smart microphone receiver 120 may be illuminated or unilluminated to indicate that the smart microphone system 100 is in the unmute state.

Figure 3:
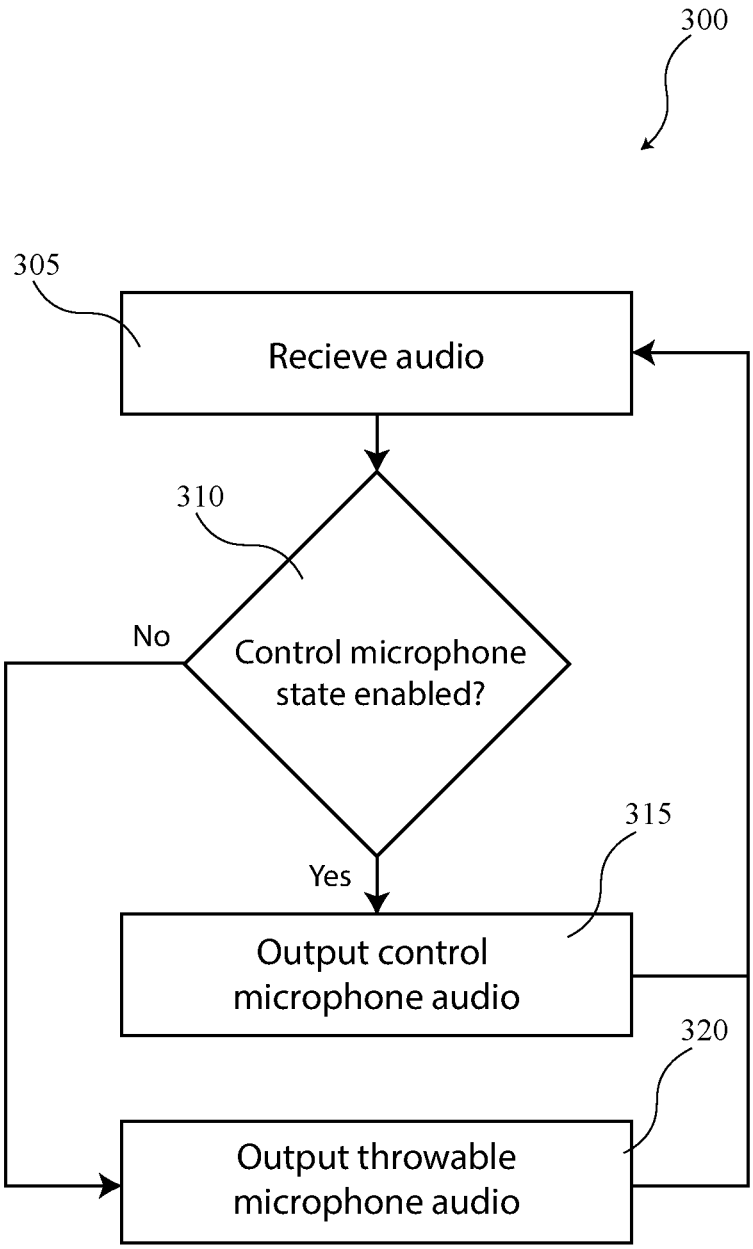
FIG. 3 is a flowchart of a process for muting a throwable microphone according to some embodiments.

FIG. 3 is a flowchart of a process 300 for muting a throwable microphone according to some embodiments. At block 305 audio can be received at the smart microphone receiver 120 from either the throwable microphone subsystem 130 or the control microphone subsystem 140.

At block 310, it can be determined whether the control microphone state has been enabled. For example, the smart microphone receiver 120 can determine that the control microphone state has or has not been enabled based on the state of a switch (e.g., throwable microphone mute button 143) at the control microphone subsystem 140. The control microphone subsystem 140 may, for example, communicate the state of the switch to the smart microphone receiver 120 periodically or when the state of the switch has been changed. The control microphone subsystem 140, for example, may store the state of the switch in memory.

if the smart microphone receiver 120 is in the control microphone enabled state, the process 300 proceeds to block 315. If the smart microphone receiver 120 is not in the control microphone enable state (e.g., the throwable microphone enable state), the process 300 proceeds to block 320.

At block 315, in some embodiments, in the control microphone enable state, the microphone 134 in the throwable microphone subsystem 130 may be turned off. In some embodiments, in the control microphone enable state, the control microphone 145 in the control microphone subsystem 140 may be turned on.

At block 315, in some embodiments, in the control microphone enable state, the wireless communication interface 131 in the throwable microphone subsystem 130 may not send audio signals to the smart microphone receiver 120. In some embodiments, in the control microphone enable state, the wireless communication interface 141 may send audio signals to the smart microphone receiver.

At block 315, in some embodiments, in the control microphone enable state, the processor 132 in the throwable microphone subsystem 130 may receive audio from the microphone 134 but may not send the audio to the smart microphone receiver 120. In some embodiments, in the control microphone enable state, the processor 142 in the control microphone subsystem 140 may receive audio from the control microphone 145 and may send the audio to the smart microphone receiver 120.

At block 315, in some embodiments, in the control microphone enable state, the smart microphone receiver 120 may receive audio signals from the throwable microphone subsystem 130 via the wireless microphone interface 124 but may not output audio from the microphone 134 to the speaker 151. In some embodiments, in the control microphone enable state, the smart microphone receiver 120 may receive audio signals from the control microphone subsystem 140 via the wireless microphone interface 124 and may output audio from the control microphone 145 to the speaker 151.

At block 315, in some embodiments, in the throwable control enable state, audio from the microphone 134 in the throwable microphone subsystem 130 may not be output via speaker 151. In some embodiments, in the control microphone enable state, audio from the control microphone 145 in the control microphone subsystem 140 may be output via speaker 151.

At block 320, in some embodiments, in the throwable microphone enable state (e.g., when the control microphone enable state is disabled), the microphone 134 in the throwable microphone subsystem 130 may be turned on. In some embodiments, in the throwable microphone enable state, the control microphone 145 in the control microphone subsystem 140 may be turned off.

At block 320, in some embodiments, in the throwable microphone enable state, the wireless communication interface 131 in the throwable microphone subsystem 130 may send audio signals to the smart microphone receiver 120. In some embodiments, in the throwable microphone enable state, the wireless communication interface 141 may not send audio signals to the smart microphone receiver.

At block 320, in some embodiments, in the throwable microphone enable state, the processor 132 in the throwable microphone subsystem 130 may receive audio from the microphone 134 and may send the audio to the smart microphone receiver 120. In some embodiments, in the throwable microphone enable state, the processor 142 in the control microphone subsystem 140 may receive audio from the control microphone 145 and may not send the audio to the smart microphone receiver 120.

At block 320, in some embodiments, in the throwable microphone enable state, the smart microphone receiver 120 may receive audio signals from the throwable microphone subsystem 130 via the wireless microphone interface 124 and may output audio from the microphone 134 to the speaker 151. In some embodiments, in the throwable microphone enable state, the smart microphone receiver 120 may receive audio signals from the control microphone subsystem 140 via the wireless microphone interface 124 and may not output audio from the control microphone 145 to the speaker 151.

At block 320, in some embodiments, in the throwable microphone enable state, audio from the microphone 134 in the throwable microphone subsystem 130 may be output via speaker 151. In some embodiments, in the throwable microphone enable state, audio from the control microphone 145 in the control microphone subsystem 140 may not be output via speaker 151.

Various other techniques may be used for controlling the output of or muting the audio from either or both the control microphone subsystem 140 or the throwable microphone subsystem 130 such as, for example, as described in U.S. patent application Ser. No. 15/158,446, which is incorporated herein in its entirety for all purposes.

Figure 4:
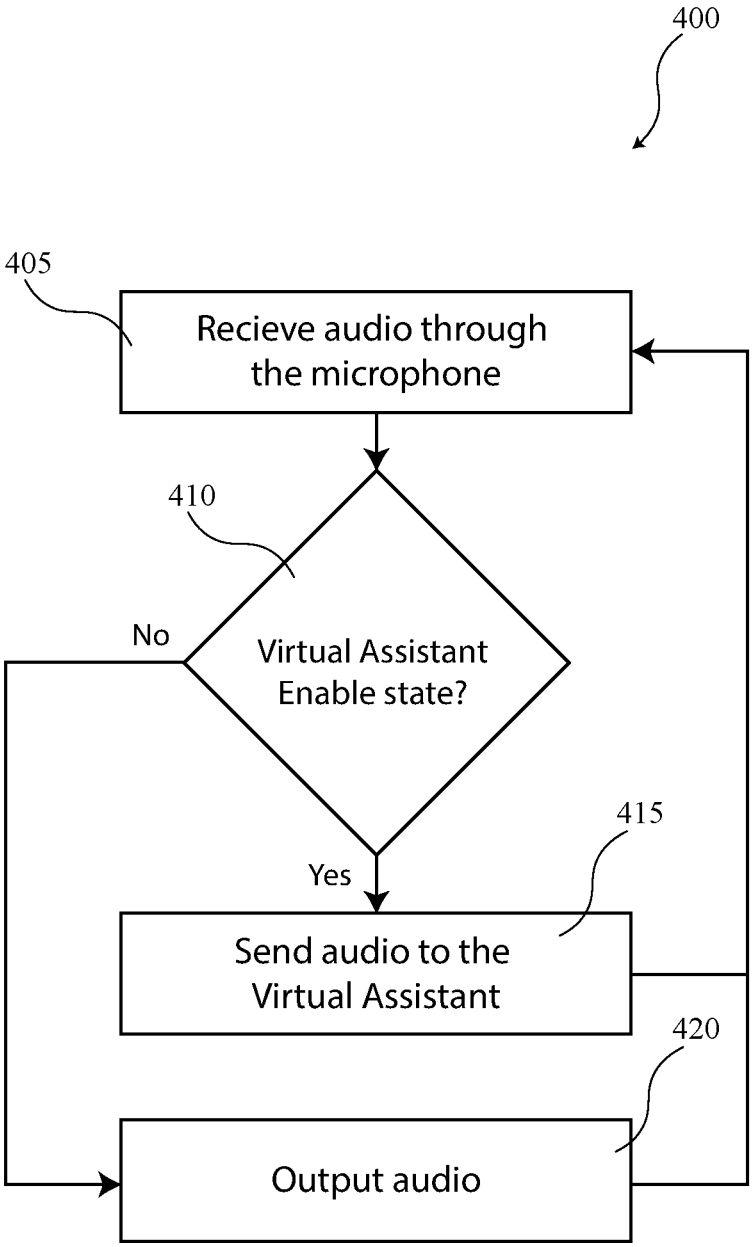
FIG. 4 is a flowchart of a process for communicating with a virtual assistant using a throwable microphone system according to some embodiments.

FIG. 4 is a flowchart of a process 400 for communicating with a virtual assistant using a throwable microphone system according to some embodiments. At block 405 audio can be received from either the throwable microphone subsystem 130 or the control microphone subsystem 140 at the smart microphone receiver 120. At block 410 it can be determined whether the smart microphone system 100 is in the virtual assistant enable state. This can be determined, for example based on a user interaction with the virtual assistant enable button 144. In some embodiments, a light may be illuminated or unilluminated on the smart microphone receiver 120 or the control microphone subsystem 140 indicating whether the smart microphone receiver 120 is in the virtual assistant enable state or not in the virtual assistant enable state.

If the smart microphone receiver 120 is in the virtual assistant enable state, then process 400 proceeds to 415. At block 415 audio received at the throwable microphone subsystem 130 or the control microphone subsystem 140 is sent to the virtual assistant. For example, the audio may be sent to the virtual assistant processor 122. In some embodiments, the audio may be sent to a virtual assistant server via the Internet 105. In some embodiments, at block 415, the audio may or may not be output via the speaker 151. In some embodiments, a light (e.g., an LED) on the control microphone subsystem 140, the throwable microphone subsystem 130, and/or the smart microphone receiver 120 may be illuminated or unilluminated to indicate that the smart microphone system 100 is in the virtual assistant enable state.

If the smart microphone receiver 120 is not in the virtual assistant enable state, then process 400 proceeds to 420. At block 420 audio received at the throwable microphone subsystem 130 or the control microphone subsystem 140 is not sent to the virtual assistant and may be output to speaker 151. In some embodiments, the output to the speaker 151 may depend on the audio level selected and/or set by the user and/or whether the speaker 151 is turned on. In some embodiments, a light (e.g., and LED) on the control microphone subsystem 140, the throwable microphone subsystem 130, and/or the smart microphone receiver 120 may be illuminated or unilluminated to indicate that the smart microphone system 100 is not in the virtual assistant enable state.

In some embodiments, audio output to speaker 151 (or generally output) can be output to a USB port, a display, a computer, a screen, a video conference, the Internet, etc.

Figure 5:
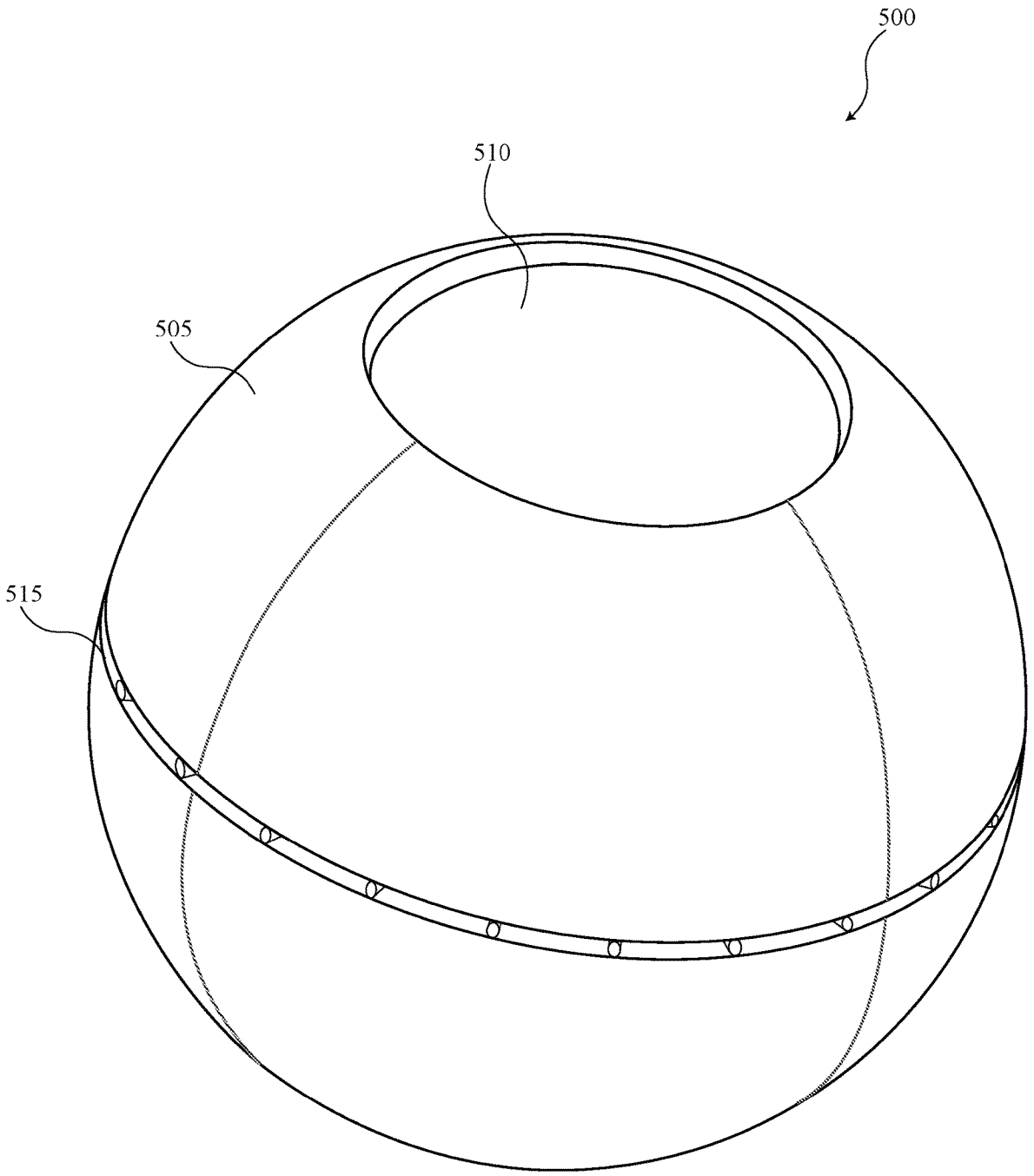
FIG. 5 is an illustration of a throwable microphone according to some embodiments.

FIG. 5 is an illustration of a throwable microphone 500 according to some embodiments. In some embodiments, the throwable microphone 500 may have a body 505 with a spherical shape with a flat portion 510. In some embodiments, the components of throwable microphone subsystem 130 shown in FIG. 1 can be embedded or disposed within the body 505 of the throwable microphone 500. For example, the wireless communication interface 131, processor 132, sensors 133, and/or a microphone 134 can be disposed within the throwable microphone 500.

In some embodiments, an orientation sensor may also be disposed within the throwable microphone 500. For example, the orientation sensor may include an accelerometer. In some embodiments, the orientation sensor may provide orientation in any number of axes, such as, for example, three (3) axes. In some embodiments, the orientation sensor may detect the orientation of the throwable microphone 500 relative to the gravitational vector.

In some embodiments, the orientation sensor may provide a signal indicating the orientation of the throwable microphone 500 such as, for example, whether the flat portion 510 is facing downward or not. The orientation sensor may provide a binary signal that indicates a downward orientation of the flat portion 510 or a non-downward orientation of the flat portion 510. The binary signal may indicate whether the flat portion 510 is within 5%-10% of being placed downward.

In some embodiments, the throwable microphone 500 may include a light ring 515. The light ring 515, for example, may include a plurality of lights embedded within the light ring 515. As another example, the light ring 515 may include a string of lights embedded within the light ring 515. The lights, for example, may include LED lights. The plurality of lights, for example, may include a first subset of lights that illuminate in a first color and a second subset of lights that illuminate in a second color. As an additional example, the plurality of lights may include a third subset of lights that illuminate in a third color. Each of the plurality of lights, for example, may illuminate in different colors.

Figure 6A:
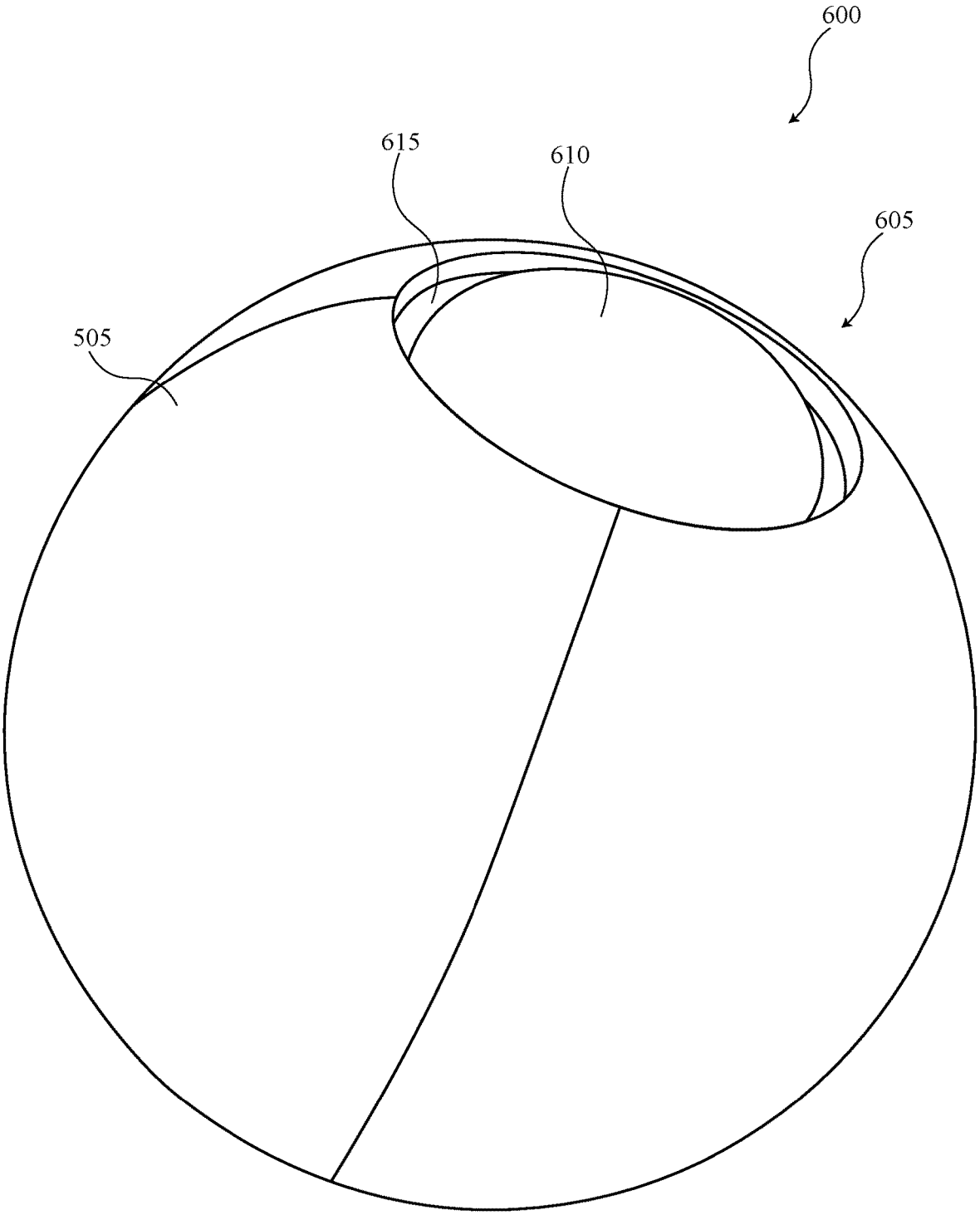
FIG. 6A and FIG. 6B illustrate a throwable microphone according to some embodiments.
Figure 6B:
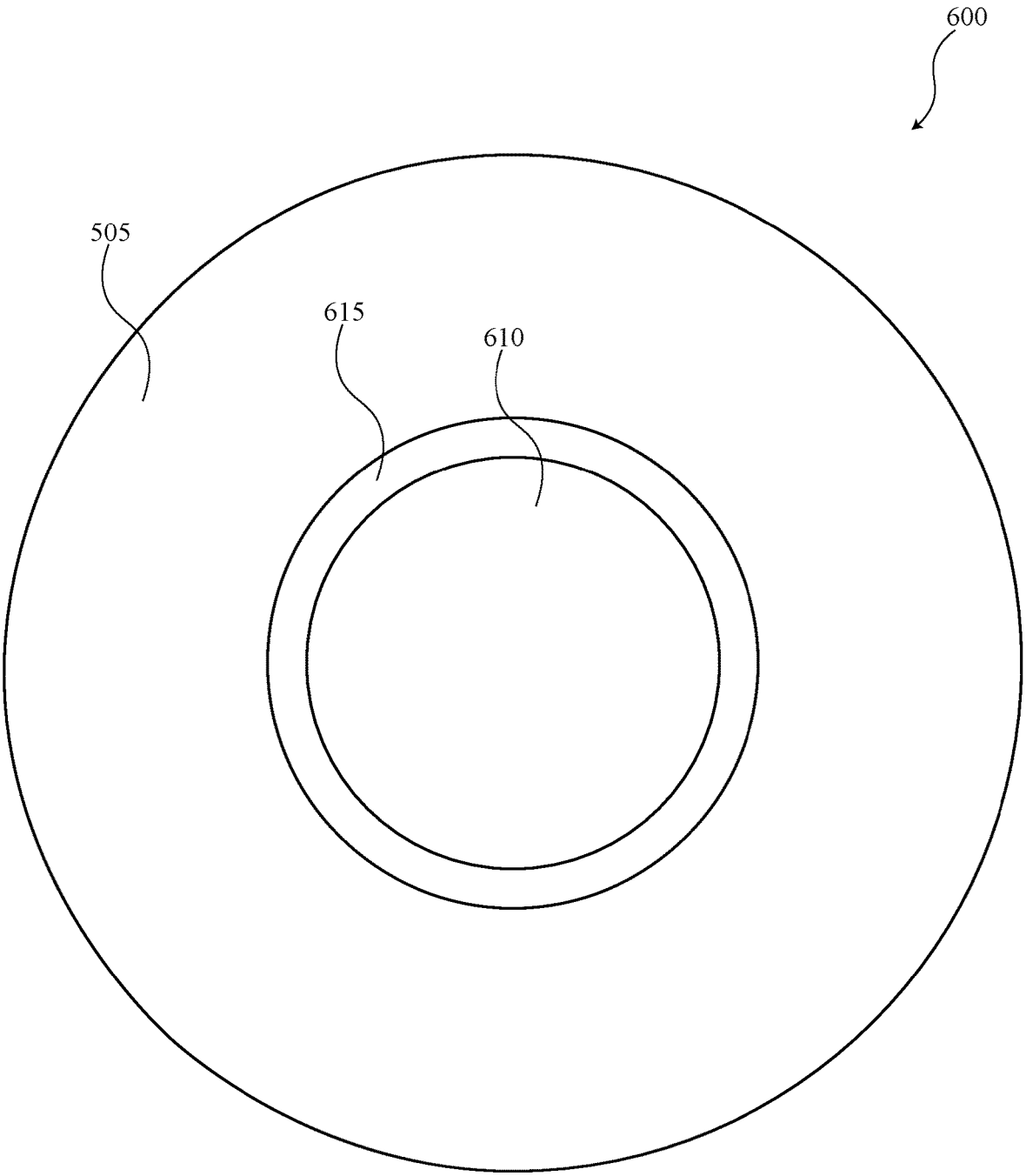

FIG. 6A is a perspective view of a throwable microphone 600 according to some embodiments. FIG. 6B is a top view of the throwable microphone 600. The throwable microphone 600 may be similar to the throwable microphone 500.

In this example, the throwable microphone 600 may include a cavity 605 cut within the body 505 of the throwable microphone 600. The cavity 605 may be cylindrical shaped. The wireless communication interface 131, processor 132, sensors 133, and/or a microphone 134 may be secured within the cavity 605.

A cover 610 can be located near the top of the cavity. The cover 610 may comprise a noise dampening material such as, for example, foam.

A light ring 615 can be disposed within the cavity 605 circumscribing the cover 610. The light ring 615 may illuminate with a plurality of different colors based on the state of the throwable microphone 600 or smart microphone system 100.

The light ring 615, for example, may include a plurality of lights embedded within the light ring 615. As another example, the light ring 615 may include a string of lights embedded within the light ring 615. The lights, for example, may include LED lights. The light ring 615, for example, may include a first portion of the light ring 615 that illuminate in a first color and a second portion of the light ring 615 that illuminate in a second color. As an additional example, the plurality of lights may include a third portion of the light ring 615 that illuminate in a third color.

In some embodiments, the processor 132 may control the state of a light ring (e.g., the light ring 515 or the light ring 615 or any other lights disposed within the body of a throwable microphone). For example, when the throwable microphone 500 is muted (e.g., because throwable microphone is oriented with the flat portion 510 facing downward or because the control microphone has sent a microphone state signal to the throwable microphone indicating the microphone should muted) the processor 132 may illuminate a light ring (or a subset of the plurality of lights) in a first color such as, for example, red. As another example, when the throwable microphone 500 is not muted (e.g., because throwable microphone is not oriented with the flat portion 510 facing downward or because the control microphone has sent a microphone state signal to the throwable microphone indicating the microphone should unmuted) processor 132 may illuminate a light ring in a second color such as, for example, green or white. As another example, the processor 132 may illuminate a light ring in a third color (e.g., blue) to indicate that audio from the microphone is being directed to a virtual assistant. As another example, the processor 132 may illuminate a light ring in a third color or may flash the lights in a pattern or change the colors in a pattern (e.g., circular pattern around the ring) to indicate virtual assistant states such as, for example, listening, thinking, speaking, etc.

In some embodiments, the processor 132 may flash the plurality of lights for period of time and at a frequency. For example, the processor 132 may flash the plurality of lights every second for 10 seconds. As another example, the processor 132 may change the frequency of the flashing of the plurality of lights over the period. In some embodiments, the processor 132 may receive a command to count down an flash according to a timer.

FIG. 7 is a flowchart of a process 700 at a throwable microphone system according to some embodiments. Process 700 may, for example, be executed by processor 132 within the throwable microphone 500. At block 705 at least a subset of the lights of a throwable microphone may be illuminated with a first color. For example, the lights arranged in the light ring 515 may be illuminated green to indicate that the throwable microphone is turned on. At block 710 audio signals may be received from microphone 134.

At block 715 the audio signals may be transmitted to another device. For example, the audio signals may be transmitted via wireless communication interface 131 to a remote receiver.

At block 720 a microphone state signal may be received. The microphone state signal, for example, may be received at the wireless communication interface 131 from a remote device such as, for example, a remote receiver or a controllable microphone or an application executing on a tablet, phone, or computer. The microphone state signal, for example, may indicate whether the microphone should be muted or unmuted.

At block 725, if the microphone state signal indicates that the throwable microphone should be muted, then process 700 proceeds to block 740. If the microphone state signal indicates that the throwable microphone should be not be muted, then process 700 proceeds to block 730.

At block 730, an orientation signal can be received from an orientation sensor. The orientation signal, for example, may indicate whether the throwable microphone is facing substantially downward or not.

At block 735, if the throwable microphone is facing substantially downward, then process 700 proceeds to block 740. If the throwable microphone is not facing substantially downward, then process 700 returns to block 705.

At block 740, the microphone is muted. A microphone (e.g., microphone 134) in a throwable microphone may be muted in a number of different ways. For example, the microphone may be turned off so that audio is not transduced to an electrical signal by the microphone. As another example, the microphone may be turned on, may receive audio, and may transduce the audio into an electrical audio signal. The microphone may not transmit the electrical audio signal. As another example, the throwable microphone may not transmit audio signals from the throwable microphone. As yet another example, the throwable microphone may transmit a mute signal to a receiver, and the receiver may not output audio signals. After block 740, process 700 may proceed to block 745.

At block 745 at least a subset of the lights of a throwable microphone may be illuminated with a first color. After block 745, process 700 may proceed to block 720.

Figure 8:
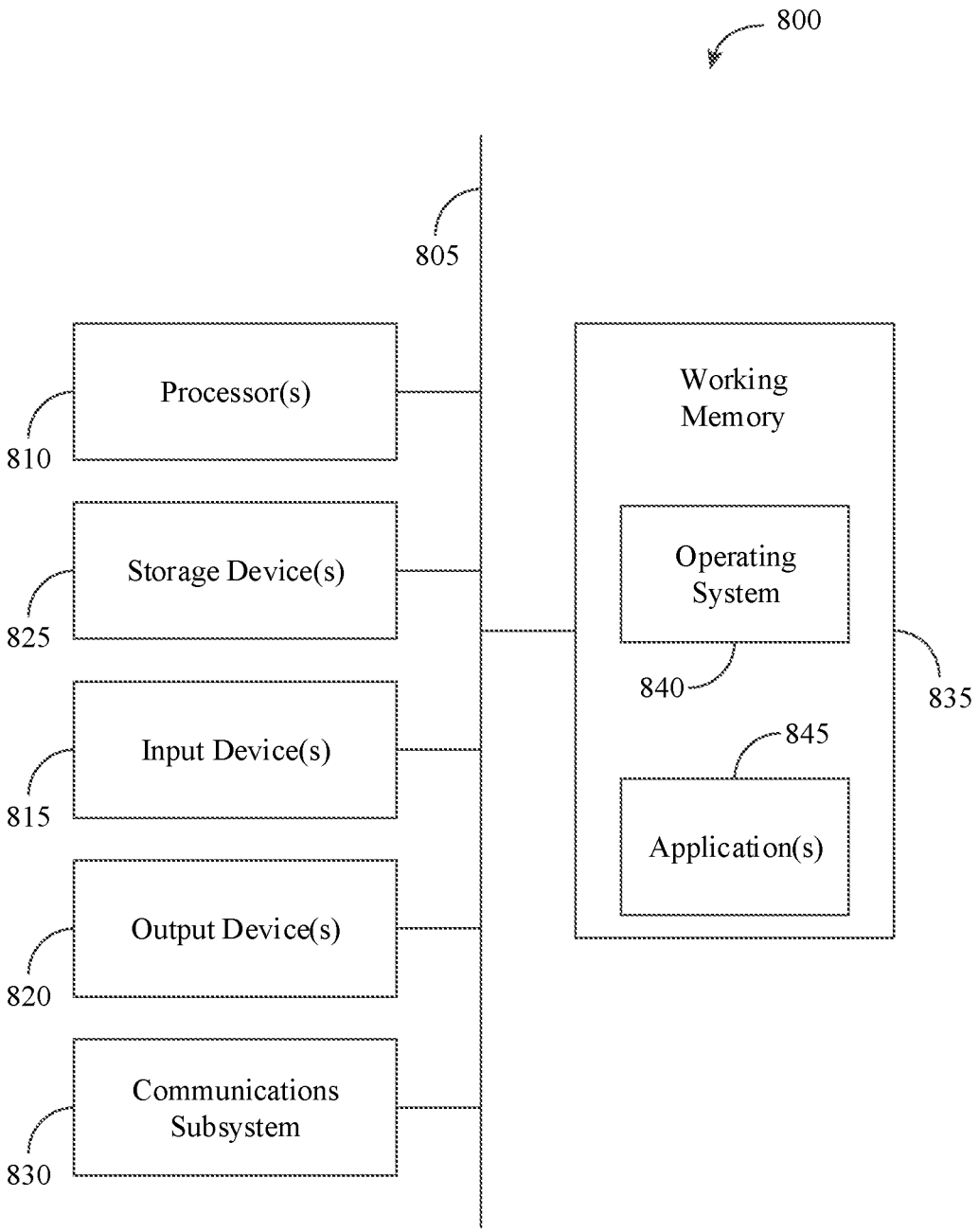
FIG. 8 shows an illustrative computational system for performing functionality to facilitate implementation of embodiments described herein.

The computational system 800, shown in FIG. 8 can be used to perform any of the embodiments of the invention. For example, computational system 800 can be used to execute processes 200, 300, 400, or 700. As another example, computational system 800 can be used perform any calculation, identification and/or determination described here. The computational system 800 includes hardware elements that can be electrically coupled via a bus 805 (or may otherwise be in communication, as appropriate). The hardware elements can include one or more processors 810, including without limitation one or more general-purpose processors and/or one or more special-purpose processors (such as digital signal processing chips, graphics acceleration chips, and/or the like); one or more input devices 815, which can include without limitation a mouse, a keyboard and/or the like; and one or more output devices 820, which can include without limitation a display device, a printer and/or the like.

The computational system 800 may further include (and/or be in communication with) one or more storage devices 825, which can include, without limitation, local and/or network accessible storage and/or can include, without limitation, a disk drive, a drive array, an optical storage device, a solid-state storage device, such as a random access memory ("RAM") and/or a read-only memory ("ROM"), which can be programmable, flash-updateable and/or the like. The computational system 800 might also include a communications subsystem 830, which can include without limitation a modem, a network card (wireless or wired), an infrared communication device, a wireless communication device and/or chipset (such as a Bluetooth device, an 802.6 device, a Wi-Fi device, a WiMax device, cellular communication facilities, etc.), and/or the like. The communications subsystem 830 may permit data to be exchanged with a network (such as the network described below, to name one example), and/or any other devices described herein. In many embodiments, the computational system 800 will further include a working memory 835, which can include a RAM or ROM device, as described above.

The computational system 800 also can include software elements, shown as being currently located within the working memory 835, including an operating system 840 and/or other code, such as one or more application programs 845, which may include computer programs of the invention, and/or may be designed to implement methods of the invention and/or configure systems of the invention, as described herein. For example, one or more procedures described with respect to the method(s) discussed above might be implemented as code and/or instructions executable by a computer (and/or a processor within a computer). A set of these instructions and/or codes might be stored on a computer-readable storage medium, such as the storage device(s) 825 described above.

In some cases, the storage medium might be incorporated within the computational system 800 or in communication with the computational system 800. In other embodiments, the storage medium might be separate from a computational system 800 (e.g., a removable medium, such as a compact disc, etc.), and/or provided in an installation package, such that the storage medium can be used to program a general-purpose computer with the instructions/code stored thereon. These instructions might take the form of executable code, which is executable by the computational system 800 and/or might take the form of source and/or installable code, which, upon compilation and/or installation on the computational system 800 (e.g., using any of a variety of generally available compilers, installation programs, compression/decompression utilities, etc.) then takes the form of executable code.

Unless otherwise specified, the term "substantially" means within 5% or 10% of the value referred to or within manufacturing tolerances. Unless otherwise specified, the term "about" means within 5% or 10% of the value referred to or within manufacturing tolerances.

Numerous specific details are set forth herein to provide a thorough understanding of the claimed subject matter. However, those skilled in the art will understand that the claimed subject matter may be practiced without these specific details. In other instances, methods, apparatuses or systems that would be known by one of ordinary skill have not been described in detail so as not to obscure claimed subject matter.

Some portions are presented in terms of algorithms or symbolic representations of operations on data bits or binary digital signals stored within a computing system memory, such as a computer memory. These algorithmic descriptions or representations are examples of techniques used by those of ordinary skill in the data processing arts to convey the substance of their work to others skilled in the art. An algorithm is a self-consistent sequence of operations or similar processing leading to a desired result. In this context, operations or processing involves physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals or the like. It should be understood, however, that all of these and similar terms are to be associated with appropriate physical quantities and are merely convenient labels. Unless specifically stated otherwise, it is appreciated that throughout this specification discussions utilizing terms such as "processing," "computing," "calculating," "determining," and "identifying" or the like refer to actions or processes of a computing device, such as one or more computers or a similar electronic computing device or devices, that manipulate or transform data represented as physical electronic or magnetic quantities within memories, registers, or other information storage devices, transmission devices, or display devices of the computing platform.

The system or systems discussed herein are not limited to any particular hardware architecture or configuration. A computing device can include any suitable arrangement of components that provides a result conditioned on one or more inputs. Suitable computing devices include multipurpose microprocessor-based computer systems accessing stored software that programs or configures the computing system from a general-purpose computing apparatus to a specialized computing apparatus implementing one or more embodiments of the present subject matter. Any suitable programming, scripting, or other type of language or combinations of languages may be used to implement the teachings contained herein in software to be used in programming or configuring a computing device.

Embodiments of the methods disclosed herein may be performed in the operation of such computing devices. The order of the blocks presented in the examples above can be varied—for example, blocks can be re-ordered, combined, and/or broken into sub-blocks. Certain blocks or processes can be performed in parallel.

The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, it should be understood that the present disclosure has been presented for purposes of example rather than limitation, and does not preclude inclusion of such modifications, variations and/or additions to the present subject matter as would be readily apparent to one of ordinary skill in the art.

That which is claimed:

1. A smart microphone system comprising:

a control microphone subsystem comprising:

a control microphone;

a control wireless transmitter that receives control audio signals from the control microphone and configured to wirelessly communicates the control audio signals; and a button disposed on a body of the control microphone subsystem that switches between a control microphone state and a throwable microphone state;

a throwable microphone subsystem comprising:

a throwable microphone body;

a throwable microphone disposed within the throwable microphone body; and a throwable wireless transmitter that receives throwable audio signals from the throwable microphone and wirelessly communicates the throwable audio signals; and a smart microphone receiver comprising:

a wireless receiver that receives the control audio signals from the control wireless transmitter and the throwable audio signals from the throwable transmitter; and an output that outputs the throwable audio signals when the button is in the throwable microphone state and outputs the control audio signals when the button is in the control microphone state.

2. The smart microphone system according to claim 1, wherein the control microphone subsystem comprises one or more lights that indicate whether the button is in the control microphone state or the throwable microphone state.

3. The smart microphone system according to claim 1, wherein the throwable microphone subsystem comprises one or more lights that indicate whether the throwable microphone is in the throwable microphone state.

4. The smart microphone system according to claim 3, wherein the throwable microphone body comprises a spherical shape; and wherein the one or more lights comprise a plurality of lights arranged in a ring within the spherical body.

5. The smart microphone system according to claim 1, wherein the control microphone subsystem comprises a first light that is illuminated when the button is in the throwable microphone state.

6. The smart microphone system according to claim 1, wherein the control wireless transmitter communicates a button state signal indicating whether the button is in the throwable microphone state or the control microphone state.

7. The smart microphone system according to claim 1, wherein the control wireless transmitter communicates a button state signal when the button is switched between the throwable microphone state and the control microphone state.

8. A throwable microphone system comprising:

a throwable microphone body;

a throwable microphone disposed within the throwable microphone body;

a throwable wireless transceiver that receives audio signals from the throwable microphone and wirelessly communicates the audio signals to a remote transceiver and receives a light configuration signal from the remote transceiver;

a controller in electrical communication with the throwable microphone and the throwable wireless transceiver that establishes a light configuration state based at least in part on the light configuration signal; and a plurality of lights disposed within the throwable microphone body and in electrical communication with the controller, the plurality of lights illuminate based on the light configuration state, wherein the plurality of lights are arranged in a ring within a flat portion.

9. The throwable microphone system according to claim 8, wherein the remote transceiver comprises:

a wireless transceiver that receives audio signals from the throwable wireless transceiver and communicates the light configuration signal; and an output that outputs the audio signals.

10. The throwable microphone system according to claim 8, wherein the throwable microphone body comprises a spherical body with the flat portion.

11. The throwable microphone system according to claim 10, wherein the plurality of lights are arranged in a ring around a circumference of the spherical body.

12. The throwable microphone system according to claim 8, comprising an orientation sensor in electrical communication with the controller, the orientation sensor produces an orientation signal, and the controller establishes the light configuration state based at least in part on the orientation signal.

13. The throwable microphone system according to claim 8, wherein:

the throwable microphone body comprises a spherical shape with a flat portion, the plurality of lights are illuminated with a first color when an orientation sensor disposed within the throwable microphone body indicates that the flat portion is facing upward, and the plurality of lights are illuminated with a second color when the orientation sensor indicates that the flat portion is facing downward.

14. The throwable microphone system according to claim 13, wherein:

the throwable microphone is muted when the orientation sensor indicates that the flat portion is facing downward.

15. The throwable microphone system according to claim 8, wherein the light configuration state comprises a lighting sequence where at least a subset of the plurality of lights flash on and off for a period of time and at a frequency according to the light configuration state.

16. A method comprising:

illuminating a plurality of lights coupled with a throwable microphone with a first color;

receiving audio signals from a microphone disposed within the throwable microphone;

transmitting the audio signals to a wireless receiver;

receiving a microphone mute signal from a controllable microphone;

receiving an orientation signal from an orientation sensor disposed within the throwable microphone;

setting the microphone state to mute when the orientation signal indicates the throwable microphone is facing downward;

setting the microphone state to mute when the microphone mute signal indicates that the throwable microphone should be muted; and illuminating the plurality of lights coupled with a throwable microphone with a second color when the microphone state is set to mute wherein the plurality of lights are arranged in a ring around a circumference of a spherical shape.

17. The method according to claim 16, wherein the microphone mute signal is received from the controllable microphone through the wireless receiver.

18. The method according to claim 16, further comprising muting the microphone when the microphone state is set to mute.

* * * * *